United States Patent [19]

Uemura et al.

[11] Patent Number: 4,618,463

[45] Date of Patent: Oct. 21, 1986

[54] PROCESS FOR PRODUCING PITCH CARBON FIBERS

[75] Inventors: Seiichi Uemura, Tokyo; Takao Hirose, Kamakura; Yoshio Shohda, Kawasaki; Takayoshi Sakamoto, Hiratsuka; Kenji Katoh, Kawasaki, all of Japan

[73] Assignee: Nippon Oil Company, Japan

[21] Appl. No.: 682,679

[22] Filed: Dec. 18, 1984

[30] Foreign Application Priority Data

Dec. 20, 1983 [JP] Japan ..... 58-238836

[51] Int. Cl.[4] ..... D01F 9/22; D01F 9/12

[52] U.S. Cl. ..... 264/29.2; 428/394; 423/447.4

[58] Field of Search ..... 264/29, 29.2; 428/394; 423/447.1, 447.2, 447.4

[56] References Cited

U.S. PATENT DOCUMENTS

| | | | |
|---|---|---|---|
| 3,629,379 | 12/1971 | Otani | 264/29.2 |
| 4,259,307 | 3/1981 | Maruyama | 423/447.4 |
| 4,284,615 | 8/1981 | Maruyama | 423/447.1 |
| 4,496,631 | 1/1985 | Adachi | 264/29.2 |

*Primary Examiner*—Jeanette Hunter

*Attorney, Agent, or Firm*—Scully, Scott, Murphy & Presser

[57] ABSTRACT

Provided is a process for producing pitch carbon fibers by subjecting pitch fibers obtained by melt-spinning a carbonaceous pitch to infusibilization treatment and then to carbonization treatment or both carbonization treatment and subsequent graphitization treatment, characterized in that a dimethyl polysiloxane having a viscosity at 25° C. in the range of 12,000 to 1,000,000 cSt is applied to the fibers after the infusibilization treatment, and the infusibilized fibers with the dimethyl polysiloxane thus applied thereto are then subjected to the carbonization treatment or both the carbonization treatment and the subsequent graphitization treatment.

4 Claims, No Drawings

PROCESS FOR PRODUCING PITCH CARBON FIBERS

BACKGROUND OF THE INVENTION

The present invention relates to a process for producing pitch carbon fibers.

Pitch carbon fibers have been produced by subjecting pitch fibers obtained by melt-spinning a carbonaceous pitch to infusiblization treatment and then to carbonization treatment or both carbonization treatment and subsequent graphitization treatment. In carbonization, however, there arises the problem that fibers adhere to each other although the adhesion is to a slight extent and consequently the interfiber separability of carbonized or graphitized fibers deteriorates. This problem has not been fully solved yet.

In the production of polyacrylonitrile carbon fibers, it is reported in Japanese Patent Publication No. 12739/1976 that a long-chain silicone oil is imparted to precursors or flameproof fibers. And various silicone oils are mentioned therein as examples of such long-chain silicone oil. However, these silicone oils exhibit no effect in the production of pitch carbon fibers.

SUMMARY OF THE INVENTION

It is the object of the present invention to provide a process for producing pitch carbon fibers superior in interfiber separability which process can prevent fibers from adhering to each other in the carbonization step.

The present invention resides in a process for producing pitch carbon fibers by subjecting pitch fibers obtained by melt-spinning a carbonaceous pitch to infusibilization treatment and then to carbonization treatment or both carbonization treatment and subsequent graphitization treatment, characterized in that a dimethyl polysiloxane having a viscosity at 25° C. of 12,000 to 1,000,000 cSt is applied to the infusiblized fibers, followed by carbonization or both carbonization and subsequent graphitization.

In the production of pitch carbon fibers, it is quite unexpected that only the above compound having a specific structure and a limited viscosity is extremely effective in improving the interfiber separability.

DESCRIPTION OF THE PREFERRED EMBODIMENTS

Carbonaceous pitches which may be used in the present invention include coal pitches such as coal tar pitch and SRC, petroleum pitches such as ethylene tar pitch and decant oil pitch, and synthetic pitch, with petroleum pitches being particularly preferred.

Pitches obtained by modification of the above pitches are also included in the carbonaceous pitch referred to herein such as, for example, pitch which has been treated with a hydrogen donor such as tetralin, pitch which has been hydrogenated under a hydrogen pressure of 20–350 kg/cm$^2$, pitch which has been modified by heat treatment, and pitch which has been modified by a suitable combination of these methods. Thus, the carbonaceous pitch in the present invention is used as a general term for precursor pitches capable of forming pitch fibers.

The carbonaceous pitch used in the present invention may be an optically isotropic pitch, or it may be an optically anisotropic pitch. The optically anisotropic pitch is a pitch containing an optically anisotropic pitch (so-called mesophase) obtained by heat-treating pitch usually at 340°–450° C. while passing an inert gas such as nitrogen gas under atmospheric pressure or reduced pressure. Particularly preferred is one having a mesophase content of 5 to 100%, preferably 60 to 100%.

It is preferable that the carbonaceous pitch used in the invention have a softening point of 240° to 400° C., more preferably 260° to 300° C.

Pitch fibers are obtained by melt-spinning the carbonaceous pitch by a known method, for example, by melting the carbonaceous pitch at a temperature higher by 38°–80° C. than its softening point, extruding the melt through a nozzle 0.1–0.5 mm in diameter and at the same time taking up the resultant filaments to obtain pitch fibers.

The pitch fibers are then subjected to infusiblization treatment under an oxidative gas atmosphere. The infusiblization treatment is carried out at a temperature usually not higher than 400° C., preferably 150°–380° C., more preferably 200°–350° C. If the treating temperature is too low, a longer treating time will be required, and if the treating temperature is too high, there will arise such a phenomenon as fusing or wastage, so both such temperatures are not desirable. As the oxidative gas, usually one or more of such oxidative gases as oxygen, ozone, air, nitrogen oxide, sulfurous acid gas and halogen are employed.

To the fibers thus infusiblized is applied a dimethyl polysiloxane having a viscosity at 25° C. of 12,000 to 1,000,000 cSt, preferably 30,000 to 1,000,000 cSt. The dimethyl polysiloxane referred to herein has the following structure:

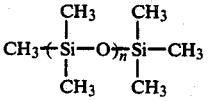

The viscosity of the dimethyl polysiloxane is very important in the present invention. If it is outside the range specified in the present invention, the interfiber separability of the fibers after carbonization will not be improved, that is, the object of the present invention cannot be attained.

The amount of the dimethyl polysiloxane applied is preferably in the range of 0.5 to 30 wt. %, more preferably 2 to 20 wt. %, based on the weight of the fibers after infusiblization. The method of applying it to the fibers is not specially limited. Known techniques such as the use of oiling roller, application, immersion and spraying can be utilized.

In order to improve the working efficiency, in applying the dimethyl polysiloxane to the infusiblized fibers it is preferably diluted with a suitable non-aqueous solvent, examples of which are aromatic hydrocarbons such as benzene, toluene and xylene, aliphatic hydrocarbons such as n-hexane and n-heptane, ketones such as methyl ethyl ketone and methyl isobutyl ketone, ethers such as methyl cellosolve, dimethyl cellosolve and ethyl ether, and halogenated hydrocarbons such as carbon tetrachloride, trichloroethylene and methyl chloride, or a dimethyl polysiloxane of a low viscosity, e.g. 10 cSt or less. The amount of the diluent used is not specially limited. For example, it is 0 to 100 times the amount of the dimethyl polysiloxane used in the invention.

Methylphenyl polysiloxane, methylhydrogen polysiloxane, polyether-modified (enhanced in water solubility), fluorine-modified and amino-modified siloxanes are also known as silicone compounds, but it has become clear that all of these silicone compounds react with the fibers in the carbonization step and cause deterioration of the interfiber separability. Further, even dimethyl polysiloxanes having viscosities in the range defined herein are not desirable if they are in an emulsified state, because their emulsion will cause deterioration of the interfiber separability.

The fibers with the dimethyl polysiloxane applied thereto are then subjected to carbonization treatment, which is carried out usually at a temperature of 800° to 2,000° C. The time required for the carbonization treatment is generally in the range of 0.1 minute to 10 hours. Subsequently, graphitization treatment is performed if necessary at a temperature of 2,000° to 3,500° C. usually for one second to one hour.

The fibers obtained by melt spinning in the process of the present invention are usually in the form of multifilament like that obtained in the conventional pitch carbon fiber production.

The following Examples and Comparative Examples are given to further illustrate the present invention, but it is to be understood that the invention is not limited thereto.

The interfiber separability in the following description was evaluated as follows. A bundle of carbonized fibers was cut into a length of 5 mm, which was then dropped slowly into a schale containing xylene at a depth of about 5 mm. Thereafter, the state of dispersion of the system was observed and evaluated in the following three stages. The state in which most of the fibers constituting the bundle are dispersed separately from each other is A; the state in which a portion of the fibers constituting the bundle are separated from each other, while the other portion are dispersed in a mutually adhered condition is B; and the state in which most of the bundle-constituting fibers are not dispersed one by one but in a mutually adhered condition in a bundled state or in plural units is C.

EXAMPLES 1-6

Petroleum precursor pitch having a mesophase content of 80 wt. % and a softening point of 280° C. was melt-spun to obtain pitch fibers having an average diameter of 13μ. The pitch fibers were subjected to infusiblization treatment in an oxygen atmosphere in which the temperature was raised to 340° C. at a rate of 10° C./min.

To the fibers (multifilament) thus infusiblized was applied dimethyl polysiloxane at such various viscosities as shown in Table 1. Then, the temperature was raised to 850° C. at a rate of 5° C./min in a nitrogen atmosphere and the fibers were held at this raised temperature for 5 minutes to obtain carbonized fibers. Results are as set out in Table 1 below, from which it is seen that the carbonized fibers thus obtained were all superior in interfiber separability.

TABLE 1

| | Viscosity of dimethyl polysiloxane cSt (@ 25° C.) | Diluent used for improving working efficiency | Dimethyl polysiloxane: Diluent mixing ratio (volume ratio) | Amount applied*[1] wt. % | Interfiber separability |
|---|---|---|---|---|---|
| Example 1 | 1,000,000 | Xylene | 10:90 | 10 | A |
| Example 2 | 100,000 | Dimethyl polysiloxane, 0.6 cSt (@ 25° C.) | 50:50 | 3 | A |
| Example 3 | 30,000 | n-Heptane | 20:80 | 15 | A |
| Example 4 | 60,000 | Methyl ethyl ketone | 15:85 | 12 | A |
| Example 5 | 1,000,000 | Toluene | 5:95 | 4 | A |
| Example 6 | 100,000 | Dimethyl cellosolve | 15:85 | 12 | A |

*[1]Amount of dimethyl polysiloxane applied to infusiblized fibers

COMPARATIVE EXAMPLE 1-9

To the infusiblized fibers obtained in Example 1 were applied 10 wt. % of such various silicone oils as shown in Table 2. Then, the temperature was raised to 850° C. at a rate of 5° C./min in a nitrogen atmosphere and the fibers were held at this raised temperature for 5 minutes to obtain carbonized fibers. Results are as set out in Table 2 below, from which it is seen that the carbonized fibers thus obtained were all poor in interfiber separability.

TABLE 2

| | Oil | Viscosity (@ 25° C.) | Interfiber Separability |
|---|---|---|---|
| Comparative Example 1 | (no oil used) | — | C |
| Comparative Example 2 | Dimethyl polysiloxane | 10 cSt | C |
| Comparative Example 3 | Dimethyl polysiloxane | 100 cSt | C |
| Comparative Example 4 | Dimethyl polysiloxane | 350 cSt | C |
| Comparative Example 5 | Dimethyl polysiloxane | 1,000 cSt | C-B |
| Comparative Example 6 | Dimethyl polysiloxane | 5,000 cSt | B |
| Comparative Example 7 | Methylphenyl polysiloxane | 500 cSt | C |
| Comparative Example 8 | Amino-modified siloxane | 1,200 cSt | C |
| Comparative Example 9 | Fluorine-modified siloxane | 300 cSt | C |

What is claimed is:

1. In a process for producing pitch carbon fibers by subjecting pitch fibers obtained by melt-spinning a carbonaceous pitch to infusiblization treatment and then to carbonization treatment or both carbonization treatment and subsequent graphitization treatment, the improvement comprises applying a dimethyl polysiloxane having a viscosity at 25° C. in the range of 12,000 to 1,000,000 cSt to the fibers after the infusiblization treatment, and subjecting the infusiblized fibers with the dimethyl polysiloxane applied thereto to the carbonization treatment or both the carbonization treatment and the subsequent graphitization treatment.

2. The process of claim 1, wherein the amount of said dimethyl polysiloxane applied to the infusiblized fibers is in the range of 0.5 to 30 weight percent based on the weight of the latter.

3. The process of claim 1, wherein said dimethyl polysiloxane is diluted with a non-aqueous solvent or a low-viscosity dimethyl polysiloxane before its application to the infusiblized fibers.

4. The process of claim 1, wherein the viscosity of said dimethyl polysiloxane is in the range of 30,000 to 1,000,000 cSt.

* * * * *